US009096816B2

(12) United States Patent
Graf et al.

(10) Patent No.: US 9,096,816 B2
(45) Date of Patent: Aug. 4, 2015

(54) COMPOSITION

(75) Inventors: Nicole Graf, Sinsheim (DE); Karlheinz Ulrich Gerhard Hahn, Ludwigshafen (DE)

(73) Assignee: RECKITT BENCKISER N.V., Hoofddorp (NL)

( * ) Notice: Subject to any disclaimer, the term of this patent is extended or adjusted under 35 U.S.C. 154(b) by 0 days.

(21) Appl. No.: 14/116,840

(22) PCT Filed: May 11, 2012

(86) PCT No.: PCT/GB2012/051030

§ 371 (c)(1), (2), (4) Date: Jan. 31, 2014

(87) PCT Pub. No.: WO2012/153143

PCT Pub. Date: Nov. 15, 2012

(65) Prior Publication Data

US 2014/0135247 A1 May 15, 2014

(30) Foreign Application Priority Data

May 12, 2011 (GB) ..... 1107885.4

(51) Int. Cl.
*C11D 3/37* (2006.01)
*C11D 3/30* (2006.01)

(52) U.S. Cl.
CPC ..... *C11D 3/3765* (2013.01); *C11D 3/30* (2013.01); *C11D 3/3723* (2013.01); *C11D 3/3769* (2013.01)

(58) Field of Classification Search
CPC ..... C11D 3/3765; C11D 3/30
USPC ..... 510/219, 514; 252/175
See application file for complete search history.

(56) References Cited

U.S. PATENT DOCUMENTS

| | | | | |
|---|---|---|---|---|
| 3,255,117 | A | 6/1966 | Knapp | |
| 3,677,820 | A | 7/1972 | Rutkowski | |
| 5,904,735 | A * | 5/1999 | Gutierrez et al. | 8/137 |
| 6,569,261 | B1 | 5/2003 | Aubay et al. | |
| 6,593,288 | B2 | 7/2003 | Aubay et al. | |
| 6,703,358 | B1 | 3/2004 | Aubay et al. | |
| 6,767,410 | B2 | 7/2004 | Aubay et al. | |
| 2003/0083223 | A1 | 5/2003 | Aubay | |
| 2003/0171246 | A1 * | 9/2003 | Boeckh et al. | 510/475 |
| 2003/0203826 | A1 | 10/2003 | Aubay | |
| 2008/0153983 | A1 * | 6/2008 | Boeckh et al. | 525/96 |
| 2011/0183883 | A1 * | 7/2011 | Hahn et al. | 510/514 |

FOREIGN PATENT DOCUMENTS

| | | | | |
|---|---|---|---|---|
| CA | 2411028 | * 12/2001 | | C11D 3/37 |
| EP | 0383480 | A1 8/1990 | | |
| EP | 0383482 | A2 8/1990 | | |
| EP | 0387997 | A2 9/1990 | | |
| FR | 2796391 | A1 1/2001 | | |
| TW | 200810923 | A 3/2008 | | |
| WO | 9905248 | A1 2/1999 | | |
| WO | WO 9905248 | A1 * 2/1999 | | C11D 3/00 |
| WO | 2004106476 | A1 12/2004 | | |
| WO | 2007022235 | A1 2/2007 | | |
| WO | 2008007590 | A1 1/2008 | | |
| WO | 2010020765 | A1 2/2010 | | |
| WO | WO 2010020765 | A1 * 2/2010 | | C11D 3/00 |

OTHER PUBLICATIONS

International Search Report mailed Feb. 11, 2013 for priority application PCT/GB2012/051030.

Office Action in related Chinese Patent Application No. 201280022668.5, mailed Dec. 19, 2014.

Search Report in related Chinese Patent Application No. 201280022668.5.

* cited by examiner

*Primary Examiner* — Nicole M Buie-Hatcher
*Assistant Examiner* — M. Reza Asdjodi
(74) *Attorney, Agent, or Firm* — Troutman Sanders LLP; Ryan A. Schneider; Chris Davis

(57) ABSTRACT

The present invention provides the use of a composition comprising a polyalkyleneimine and/or salts or derivative thereof and an amphoteric polymer for the prevention of corrosion of non-metallic in organic items during a washing or rinsing process, in particular during an automatic dishwashing process.

11 Claims, No Drawings

COMPOSITION

CROSS-REFERENCE TO RELATED APPLICATIONS

This application is a US National Stage of International Application No. PCT/GB2012/051030, filed 11 May 2012, which claims the benefit of GB 1107885.4, filed 12 May 2011, both herein fully incorporated by reference.

TECHNICAL FIELD

The present invention relates to an improved composition for use in the protection of non-metallic inorganic materials such as glassware in an automatic ware washing machine, preferably a dishwashing process.

BACKGROUND

The problem of corrosion of non-metallic inorganic items, such as glassware, ceramic and enamel materials, when subjected to automatic dishwashing processes is well recognised in the art. For example, it has been proposed that the problem of glassware corrosion is the result of two separate phenomena. Firstly, it has been suggested that the corrosion is due to leakage of minerals from the glass network, accompanied by hydrolysis of the silicate network. Secondly, it is proposed that the silicate material is then released from the glass.

These phenomena can cause damage to glassware after a number of separate wash cycles. The damage may include cloudiness, scratches, streaks and other discoloration/detrimental effects.

Silicate materials have been proposed as agents that are effective in preventing materials from being released by the glass composition. However, the use of silicate compounds can have detrimental side effects, such as the tendency to increase separation of silicate material at the glass surface.

A further solution has been to use metals such as zinc, either in metallic form (such as described in U.S. Pat. No. 3,677,820) or in the form of compounds. The use of soluble zinc compounds in the prevention of glassware corrosion in a dishwasher is described in, for example, U.S. Pat. No. 3,255,117.

European Patents; EP-A-0 383 480, EP-A-0 383 482 and EP-A-0 387 997) describe the use of water insoluble compounds including zinc silicate, zinc carbonate, basic zinc carbonate ($Zn_2(OH)_2CO_3$), zinc hydroxide, zinc oxalate, zinc monophosphate ($Zn_3(PO_4)_2$) and zinc pyrophosphate ($Zn_2P_2O_7$) for this purpose.

Bismuth has been used as an additive to aid the prevention of corrosion of glazed glassware corrosion. For example, BE 860180 describes the use of bismuth to avoid damage of decorated, glazed articles.

The value of bismuth in this purpose has been diminished by the detrimental effects that the use of bismuth compound has on other components of the washing process or detergent composition. In soluble bismuth compounds can cause the formation of stains on kitchenware items e.g. glassware and cutlery which come into contact with these compounds. For these reasons the use of bismuth alone as a glaze protector has been avoided, although a combination of zinc and bismuth has been found to address this issue (see WO-A-04/106476).

However, it has been found that the use of heavy metal compounds in some circumstances reduce the bleaching performance of a dishwashing composition on bleachable stains such as tea stains. Furthermore, for environmental reasons, it is becoming increasingly desirable to limit (and especially to avoid) the use of heavy metals in detergent formulations.

WO2010/020765 proposed a solution to this problem of glass and tableware erosion that did not require the use of heavy metals. This document, which is hereby incorporated by reference, disclosed that polyalkyleneimines were highly effective additives for the prevention of corrosion of non-metallic inorganic items in automatic washing machines.

However, further to this, it has since been found that while the polyalkyleneimines do improve the corrosion protection their use has unexpectedly been found to cause poor rinse performance. This leads to unattractive spotting on glassware.

It is the object of the present invention to overcome the poor rinse performance that accompanies the use of polyalkyleneimine formulations.

STATEMENT OF INVENTION

In a first aspect of the present invention there is provided a composition comprising a polyalkyleneimine and at least one amphoteric polymer.

According to one embodiment, the polyalkyleneimine preferably comprises a polyethyleneimine and most preferably it is polyethyleneimine.

According to one embodiment the number average molecular weight of the polyalkyleneimine and/or salt or derivative thereof is in the range of from 100 to 5,000,000.

According to one embodiment the at least one amphoteric polymer is a hydrophilic polymer.

According to another embodiment the at least one amphoteric polymer is an aqueous based acrylic acid amine-functional polymer.

According to another embodiment the at least one amphoteric polymer is a quaternized ammonium acryl amide acrylic acid copolymer.

According to another embodiment the at least one amphoteric polymer is produced by Rhodia and sold under the trade name Mirapol Surf S P-free powder.

According to one embodiment of the present invention the composition used is an automatic dishwashing composition comprising the polyalkyleneimine and/or salt or derivative thereof in an amount of from 0.0001 wt % to 50 wt % of the composition.

According to another embodiment the composition used is an automatic dishwashing rinse aid comprising the polyalkyleneimine and/or salt or derivative thereof in an amount of from 0.0005 wt % to 70 wt % of the composition.

According to yet another embodiment the composition used is a water softening salt composition comprising the polyalkyleneimine and/or salt or derivative thereof in an amount of from 0.0001 wt % to 90 wt % of the composition.

DETAILED DESCRIPTION OF THE INVENTION

It has been found that the rinse problems of the compositions caused by the presence of the polyalkyleneimines can be ameliorated by the addition of an amphoteric polymer.

Any amphoteric polymer may be used to achieve this effect. Preferably the amphoteric polymer is a hydrophilic polymer.

The protection of the non-metallic inorganic items, such as glassware, ceramic and enamel as demonstrated in WO2010/020765 is unaffected by the addition of the amphoteric polymer, to the polyalkyleneimine containing detergent formulation.

Preferably the amphoteric polymers suitable for use in combination with the polyalkyleneimine preferably include at least (1) an acidic monomer having or capable of forming an anionic charge and (2) a monomer having a permanent cationic charge or is capable of forming a cationic charge upon protonation.

Further, the polymer is preferably an aqueous based acrylic acid amine-functional polymer. An example of such a polymer is a quaternized ammonium acryl amide acrylic acid copolymer. Hydrophilic polymers suitable for inclusion in the composition of the invention are described in U.S. Pat. Nos. 6,569,261, 6,593,288, 6,703,358 and 6,767,410, the disclosures of which are incorporated herein by reference.

These patent documents describe water-soluble or water-dispersible copolymers including, in the form of polymerized units (1), at least one amine-functional monomer (2), at least one hydrophilic monomer with an acidic nature and optionally at least one hydrophilic monomer with ethylenic unsaturation and with a neutral charge (3). The copolymers include quaternized ammonium acryl amide acid copolymers. It will be appreciated that selection of appropriate relevant materials and structures as to the polymer should be guided in more detail by the teachings of these patent documents. A preferred copolymer of the above type is produced by Rhodia and sold under the trade name MIRAPOL SURF S, in particular that sold under the trade name MIRAPOL SURF S P-free powder.

The amphoteric polymer is preferably used in a washing or rinsing cycle in an automatic dishwasher in an amount of from 0.01 mg up to 10 g, more preferably from 0.05 mg up to 5 g, more preferably from 0.1 mg up to 1 g and most preferably from 0.5 mg up to 100 mg per wash or rinse cycle.

It is also possible to use the amphoteric polymer in both the wash and the rinse cycles of an automatic dishwashing machine.

The compositions of the present invention may include the amphoteric polymer from 0.001 and 90 wt %, preferably from 0.005 to 50 wt %, more preferably from 0.01 to 10% by weight.

The term polyalkyleneimine as used herein encompasses any alkyleneimine comprising 2 or more alkyleneimine repeating units, and thus alkyleneimine oligomers, such as ethyleneimine oligomers are included within the term. Typically the polyalkyleneimine will comprise from 2 to 50,000 alkyleneimine repeating units, preferably to 25,000, such as 50 to 10,0000.

Unless otherwise stated or required by the context, all percentages herein are given as weight percentages based on the total weight of the composition. Reference herein to "polyalkyleneimine(s)" includes reference to the salts and/or derivatives thereof. References to "amphoteric polymer(s)" includes reference to the salts and/or derivatives thereof.

The polyalkyleneimine and/or salts or derivatives thereof is used in an effective amount to provide the aforementioned corrosion protection effects during a washing or rinsing cycle. The polyalkyleneimine is preferably used in a washing or rinsing cycle in an automatic dishwasher in an amount of from 0.01 mg up to 10 g more, preferably from 0.05 mg up to 5 g, more preferably from 0.1 mg up to 1 g and most preferably from 0.5 mg up to 100 mg per wash or rinse cycle. It is also possible to use the polyalkyleneimine in both the wash and the rinse cycles of an automatic dishwashing machine.

Most preferably the polyalkyleneimine and amphoteric polymer are part of a detergent or rinse formulation. The detergent formulation may be any common detergent formulation of the type usually employed with automatic dishwashers. The formulation may comprise a liquid, gel, powder or tablet formulation which can be at least partially packed or filled into a water soluble pouch. Similarly a coating may be used to coat at least a portion of the formulation. The monodose detergent formulation may be sub-divided with different portions separated from each other.

Where the formulation is a liquid/gel generally the polyalkyleneimine and amphoteric polymer are present in solution within the liquid/gel. However, it is also contemplated to have the polyalkyleneimine and/or amphoteric polymer present in the liquid/gel in the form of an insoluble solid salt/compound so that the polyalkyleneimine and/or amphoteric polymer may comprise a suspended particle (e.g. such as a "speckle" typically found in these formulations). For compositions having a water soluble coating or pouch it is contemplated to have the polyalkyleneimine and/or amphoteric polymer as part of the coating/pouch composition.

The detergent formulation normally comprises other components which are typically found in dishwasher detergent formulations. In this regard the detergent formulation typically comprises one or more components selected from the group comprising surfactants (non-ionic, anionic, cationic and zwitterionic), builders, enzymes, foam suppressants, bleaches, bleach activators, thickeners, perfumes, dyes, corrosion inhibitors.

The polyalkyleneimine and amphoteric polymer may be present in an automatic dishwasher (ADW) detergent composition. In this case the polyalkyleneimine preferably comprises from 0.0001% wt-50% wt of the detergent composition, more preferably from 0.0005% wt-5% wt and most preferably 0.001% wt-1% wt of the dishwasher detergent composition (e.g. 10 mg for a 20 g tablet).

The ADW detergent composition may have a pH from 6-12. The detergent composition may be neutral with a pH from 6-8 or an alkaline formulation with a pH from 8-12, preferably between 9 and 11.

The ADW detergent composition may be phosphate free.

The polyalkyleneimine and amphoteric polymer may be also be included in a rinse aid composition. In this case the rinse aid composition preferably comprises from 0.0005% wt-70% wt of the polyalkyleneimine, more preferably from 0.001% wt-50% wt and most preferably 0.005% wt-25% wt, such as from 0.01% wt-5% wt of the rinse aid composition. The rinse aid composition preferably comprises from 0.0005% wt-70% wt of the amphoteric polymer, more preferably from 0.001% wt-50% wt and most preferably 0.005% wt-25% wt, such as from 0.01% wt-% wt of the rinse aid composition.

The rinse aid composition may be acidic and may comprise citric acid.

The polyalkyleneimine and amphoteric polymer may be also be included in a water softening salt composition. These are commonly used for the regeneration of the ion exchanger present in an automatic dishwasher. In this case the water softening salt composition preferably comprises from 0.0001% wt-90% wt of the water softening salt composition, more preferably 0.001% wt-50% wt and most preferably 0.005% wt-25% wt such as 0.01 to 10% wt of the water softening salt composition.

The polyalkyleneimine and amphoteric polymer may be included in a machine cleaner/machine additive composition. In either of these cases the composition comprises from 0.0001% wt-90% wt of the amphoteric polymer, more preferably from 0.0005% wt-50% wt of the amphoteric polymer and most preferably 0.001% wt-10% wt of the amphoteric polymer. The composition also comprises from from 0.0001% wt-90% wt of the polyalkyleneimine, more preferably from 0.0005% wt-50% wt of the polyalkyleneimine and most preferably 0.001% wt-10% wt of the polyalkyleneimine.

Polyalkyleneimines are commercially available from different suppliers under various trade names e.g. Lugalvan™ P (ex BASF) and Lupasol™ BASF. Polyalkyleneimines are known to have a very widespread range of average molecular weights, from around 100 up to several million, preferably in the range of from about 100 to about 5,000,000 most preferably of from about 250 to 1,000,000, such as from about 400 to about 100,000. The alkylene group, which is preferably a linear or branched chain, may also for example be cyclic. The alkylene group preferably has from 1 to 50 C atoms, more preferably from 2 to 20, such as from 2 to 5, such as ethylene. These polymers can be linear, branched or end capped.

Suitable end-caps include alkylenediamines such as $C_2$-$C_5$ alkylenediamines e.g. ethylenediamines. The polymers may be derivatized e.g. by alkoxylation, ethoxylation, propoxylation protonated, and be provided with or without a counter-ion.

If a counter ion is present any suitable counter-ion may be used.

If a counter-ion is used which is known to have negative effects in the dishwashing process. e.g. chloride, the chloride counter-ion is preferably present in the dishwashing process at a concentration of less than 200 mg/liter of dishwashing liquor, more preferably at less than 100 mg/liter most preferably less than 50 mg/liter in order to avoid rusting, pitting or other types of corrosion on stainless steel e.g. cutlery.

Common commercially available polyalkyleneimines are usually available as an admixture mixture of one or more of the above species. A solvent such as water may be present. Any one of these species would be suitable for use in the present invention.

The invention is demonstrated by the following non-limiting example.

Experimental Results

The following base composition A, was utilised in the rinse tests to determine spotting levels.

| Components of composition A | % wt |
|---|---|
| Sodium Tripolyphosphate | 45.0 |
| Sodium Carbonate | 24.0 |
| Sodium Bicarbonate | 3.0 |
| Citric acid | 1.0 |
| Cellulose | 1.0 |
| Lactose | 1.0 |
| Sodium disilicate | 3.0 |
| Polyethyleneglycol (PEG) | 7.0 |
| Sodium Percarbonate | 10.0 |
| TAED | 2.0 |
| Protease | 0.9 |
| Amylase | 0.4 |
| Non-ionic Surfactant | 1.0 |
| Benzotriazole | 0.2 |
| Perfume + Dye | 0.5 |

Rinse Test Evaluation Data

| Experiments | Composition A 20 grams only | Composition A 20 g + Lupasol ™ 15 mg | Composition A 20 g Lupasol ™ 15 mg + Mirapol Surf S (P-free powder) ™ 50 mg |
|---|---|---|---|
| | Spotting Score Results | | |
| Long drink glasses | 5.7 | 4.0 | 5.0 |
| Whiskey glasses | 6.0 | 4.0 | 5.5 |

-continued

| Experiments | Composition A 20 grams only | Composition A 20 g + Lupasol ™ 15 mg | Composition A 20 g Lupasol ™ 15 mg + Mirapol Surf S (P-free powder) ™ 50 mg |
|---|---|---|---|
| | Spotting Score Results | | |
| Ventura knives | 4.3 | 4.7 | 4.8 |
| Porcelain plates | 4.9 | 4.1 | 4.6 |
| Melamine Plastic plates | 4.4 | 4.0 | 4.0 |
| PP Bowl | 3.3 | 3.0 | 4.0 |

Base composition A was tested on its own, with a polyalkyleneimine (Lupasol™) and in combination with both a polyakyleneimine (Lupasol™) and an amphoteric polymer (Mirapol Surf S (p-free powder)™)

The results show that the addition of an amphoteric polymer improves the spoting performance of the combination of the detergent composition with the polyalkyleneimine.

Glassware protection was maintained with the addition of the amphoteric polymer.

Rinse Test Method Details

Test method: R206 V1

Machine: Bosch SGS058 MO2 EU/36

Program: Eco 50° C.+Various Speed (No 3 in 1 function)

Water Hardness: 21° GH

Evaluators: 1 trained person.

Spotting Scores

| Score | Result |
|---|---|
| 10 | No streaks and spots |
| 9 | Few slight streaks and/or a few small spots |
| 8 | Some slight streaks and/or some small spots |
| 7 | Several slight streaks and/or a few medium size spots |
| 6 | Some moderate streaks and/or medium size spots |
| 5 | Moderate streaks and/or a few big spots |
| 4 | Some strong streaks and/or many big spots |
| 3 | Strong streaks and/or many big spots |
| 2 | Very strong streaks and/or numerous big spots |
| 1 | Whole surface is covered with very strong streaks and/or spots |

The invention claimed is:

1. A composition comprising:

a polyalkyleneimine; and an amphoteric polymer;

wherein the polyalkyleneimine is in the amount of 0.0001 to less than 0.1 wt % of the composition and the amphoteric polymer is in an amount between 0.01 to 10 wt % of the composition;

wherein the number average molecular weight of the polyalkyleneimine is in the range of from 100 to 5,000,000; and wherein the amphoteric polymer is a quaternized ammonium acrylamide acrylic acid copolymer.

2. The composition according to claim 1, wherein the polyalkyleneimine comprises a polyethyleneimine.

3. The composition according to claim 1, wherein the composition is an automatic dishwashing detergent.

4. The composition according to claim 1, wherein the composition is an automatic dishwashing rinse aid comprising the polyalkyleneimine in an amount between 0.0005 wt % to less than 0.1 wt % of the composition.

5. The composition according to claim 1, wherein the composition is a water softening salt composition.

6. The composition according to claim 1, wherein the composition is a machine cleaner/machine additive composition.

7. The composition according to claim 1, wherein the average molecular weight of the polyalkyleneimine is in the range of 400 to 100,000.

8. The composition according to claim 1, wherein the composition comprises at least one formulation selected from the group consisting of a liquid, a gel, a powder and a tablet.

9. The composition according to claim 8, wherein the composition is packed into a water soluble pouch that is subdivided such that each formulation is separated from the other formulations.

10. The composition according to claim 3, comprising the polyalkyleneimine in an amount between 0.001 wt % to less than 0.1 wt % of the composition.

11. The composition according to claim 3, wherein the composition is phosphate free.

* * * * *